US005368091A

United States Patent [19]

Seebald et al.

[11] Patent Number: 5,368,091

[45] Date of Patent: Nov. 29, 1994

[54] TEMPERATURE MONITORING METHOD AND SYSTEM FOR REGENERATIVE HEAT EXCHANGER

[75] Inventors: James D. Seebald; Carlton L. Bledsoe, both of Wellsville; William T. Amundson, Cuba, all of N.Y.

[73] Assignee: ABB Air Preheater, Inc., Wellsville, N.Y.

[21] Appl. No.: 195,913

[22] Filed: Feb. 10, 1994

[51] Int. Cl.[5] ..... F28D 19/04; F28G 15/00

[52] U.S. Cl. ..... 165/5; 165/11.1

[58] Field of Search ..... 165/5, 11.1

[56] References Cited

U.S. PATENT DOCUMENTS

| | | | |
|---|---|---|---|
| 3,534,549 | 10/1970 | DuRocher | 165/5 |
| 3,730,259 | 5/1973 | Wixson et al. | 165/5 |
| 3,861,458 | 1/1975 | Ostrander et al. | 165/5 |
| 4,099,165 | 7/1978 | Botnen | 165/5 |
| 4,383,572 | 5/1983 | Bellows | 165/5 |
| 4,813,003 | 3/1989 | Cox et al. | 364/557 |
| 4,823,861 | 4/1989 | Warrick | 165/5 |
| 5,097,889 | 3/1992 | Ritter | 165/5 |

FOREIGN PATENT DOCUMENTS

| | | | |
|---|---|---|---|
| 158644 | 12/1963 | U.S.S.R. | 165/5 |
| 1605103 | 11/1990 | U.S.S.R. | 165/5 |

*Primary Examiner*—Albert W. Davis, Jr.

*Attorney, Agent, or Firm*—Chilton, Alix & Van Kirk

[57] ABSTRACT

A system and method for detecting hot spots in a rotary regenerative air preheater which compensates for normal variations in the temperature of the incoming hot gas stream or incoming cold air stream. Alarm conditions are based on calculations relating to the average and maximum outlet gas or outlet air over a period of time compared to the air and gas inlet temperature. The alarm is triggered if the maximum values deviate from the time averaged values more than a selected percentage.

5 Claims, 3 Drawing Sheets

TEMPERATURE MONITORING METHOD AND SYSTEM FOR REGENERATIVE HEAT EXCHANGER

BACKGROUND OF THE INVENTION

This invention relates to the detection of an abnormal temperature within the heat transfer element of a regenerative heat exchanger and particularly relates to such a system for rotary regenerative air preheaters.

It has long been known that gas to air regenerative heat exchangers can sometimes experience an excessively high temperature which may lead to a fire within the confines of the heat transfer surfaces. The heat containing gases are typically the exhaust flue gases from a combustion process. As these hot flue gases are directed through a rotary regenerative heat exchanger, the fly ash and unburned products of combustion carried by the flue gas are deposited on the surface of the heat exchanger plates. These deposits continue to build up until air and flue gas flow through the heat exchanger are reduced at least in the region of the deposits. This causes the temperature to rise to the point where the deposits glow and cause a hot spot. If not detected and corrected, this can lead to fires in the heat exchanger. Early detection of such hot spots and fires is critical to containment and correction.

The typical air preheater is normally run at steady-state conditions, with the gas and air inlet temperatures and the gas and air flow rates being nearly constant over a long period of time. However, at one time or another, every air preheater goes through some kind of transient, due to a change in either the air or gas inlet temperatures or in the air or gas flow rates or some combination of these. For example, when an air preheater supplies combustion air to a boiler, the air preheater experiences a transient when the boiler is going through a start-up, a shut-down, or a change in load.

Superimposed on the fluid temperatures measured during steady-state or transient conditions are normal and continuous (but small) stochastic fluctuations. It is also possible that even under steady-state conditions, there may be differences in the air outlet temperature from one rotor compartment to another. These compartment-to-compartment variations in temperature could be due to non-uniform fouling, corrosion, or plugging of the heat transfer matrix in the various compartments of the rotor.

In order to detect an abnormal temperature condition within the heat transfer matrix without setting off a spurious alarm signal, it is necessary for the temperature monitoring system to be able to differentiate between the normal temperature changes caused by transients, stochastic fluctuations, and rotor non-uniformities, and an abnormally high temperature caused by a fire. This means that the relative magnitudes of the various normal fluctuations must be estimated or measured, so that the alarm set point can be defined to be at some level above the worst-case normal fluctuation. In most instances, the greatest fluctuations will be caused by transients due to changes in the gas or air inlet temperatures. Stochastic fluctuations should be quite small, probably on the order of 1° F. Fluctuations due to rotor non-uniformities will vary from unit to unit, but their magnitude would probably lie somewhere between 1° and 10° F. Fluctuations due to transient operating conditions could be greater than 10° F.

There have been many systems proposed and used for the detection of these hot spots. Typically, prior art hot spot detectors have relied on a single pass of the hot spot past a sensor which detects the hot spot on the basis of a predetermined fixed temperature threshold above which a measured temperature is considered to be abnormal. The use of such a fixed threshold temperature ignores the fact that a number of normal variables, as mentioned above, could cause the temperature to exceed the fixed threshold and trigger an alarm or initiate corrective action in unwarranted situations. Examples of such systems include infrared detectors which measure the temperature of the rotor. Infrared detection systems are relatively expensive and require significant maintenance of the detectors and electronics. Prior art thermocouple systems have used the fixed set point method with its attendant disadvantages.

SUMMARY OF THE INVENTION

The present invention provides a system for detecting hot spots in a regenerative heat exchanger which compensates for conditions which would cause normal variations in the temperature of the heat exchanger or the exit gas (air) stream. More particularly, the system compensates for variations in the temperature of the incoming hot gas stream and/or incoming cold gas (air) stream which would cause normal variations in the temperature of the heat exchanger plates or the temperatures of the outlet gas (air) stream. Specifically, alarm conditions are based upon calculations relating to the average and maximum outlet gas or air temperature over a period of time compared to the air and gas inlet temperatures.

DESCRIPTION OF THE PREFERRED EMBODIMENTS

Figure 1:
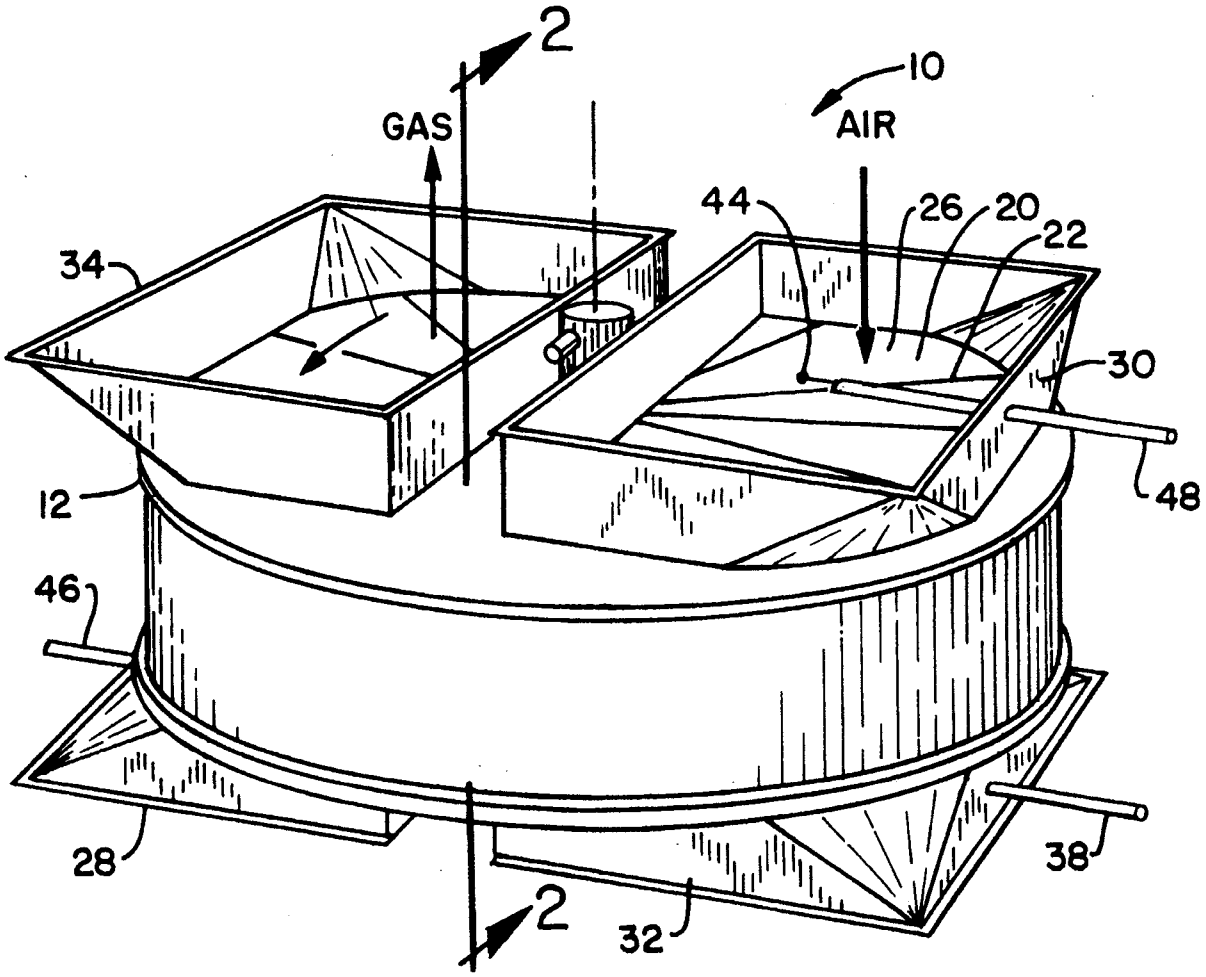
FIG. 1 is a perspective view of a rotary regenerative heat exchanger that depicts a portion of the present invention.

FIG. 1 depicts a typical rotary regenerative air preheater 10 comprising a cylindrical housing 12 that encloses a rotor 14 mounted on the central rotor shaft 16 for rotation within the housing 12. The rotor 14 typically comprises a casing 18 and a series of compartments 20 formed by radial partitions 22. The compartments 20 each contain a matrix of heat absorbent material 26 usually in the form of corrugated plates or the like that provide passageways for the flow of gases (air and flue gas) in a known manner.

Figure 2:
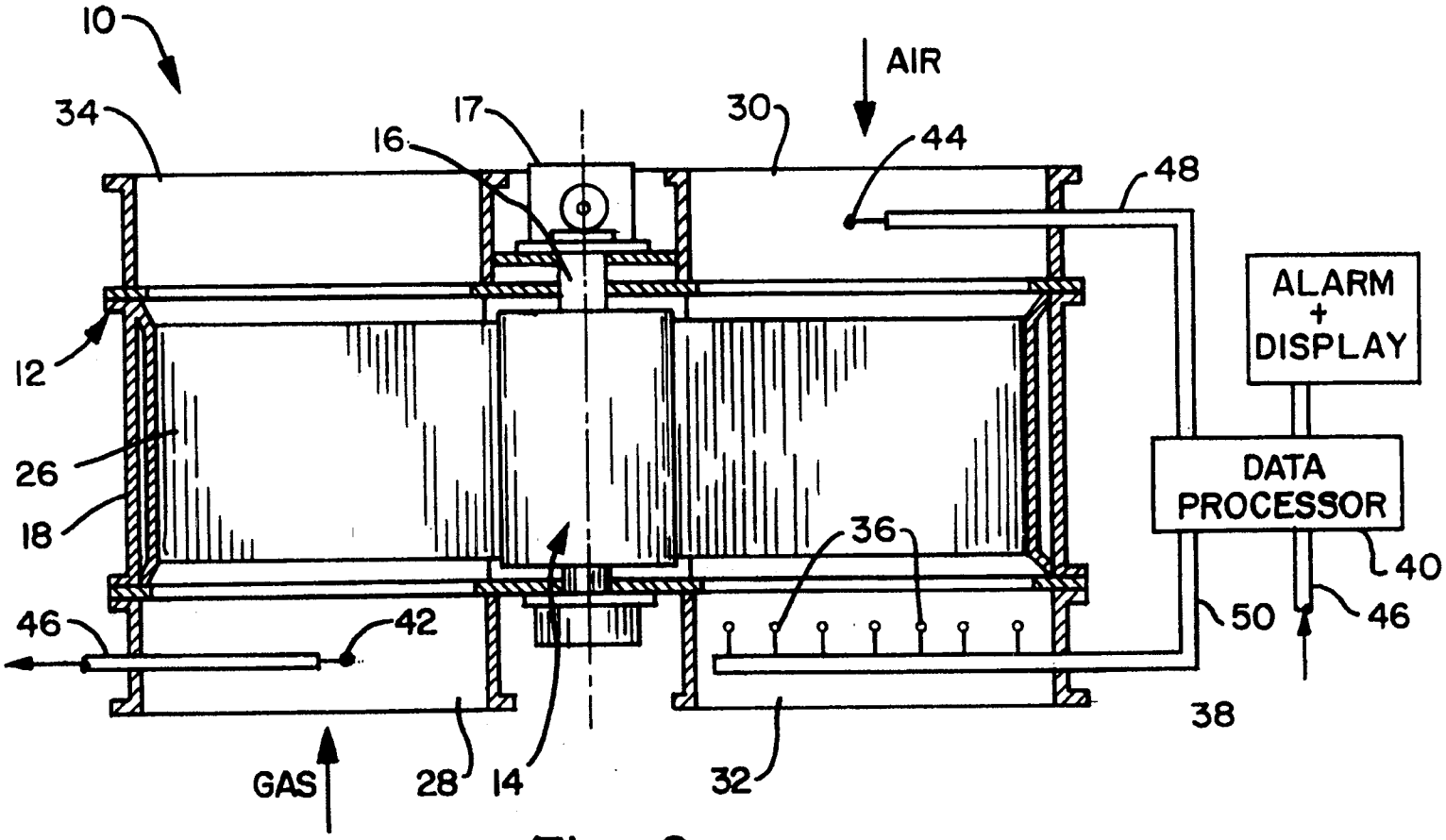
FIG. 2 is a side elevation view as seen from line 2—2 of FIG. 1 in cross section illustrating the present invention.

The rotor is driven by a motor (not shown) to advance the heat absorbent matrix material alternately between the heating fluid passing through one side of the rotor in one direction and a fluid to be heated passing through the other side of the rotor in the opposite direction. As shown in FIGS. 1 and 2, the hot fluid, flue gas, enters the air preheater through the gas inlet duct 28 and heat is absorbed by the matrix. As the rotor is rotating, this heated matrix is rotated to the other side where cool air enters through the air inlet duct 30. As the cool air passes through the matrix, it absorbs heat therefrom and is discharged through the air outlet duct 32. The preheated air then goes to a boiler, furnace or other equipment or process while the cooled flue gas is discharged through gas outlet duct 34.

Figure 3:
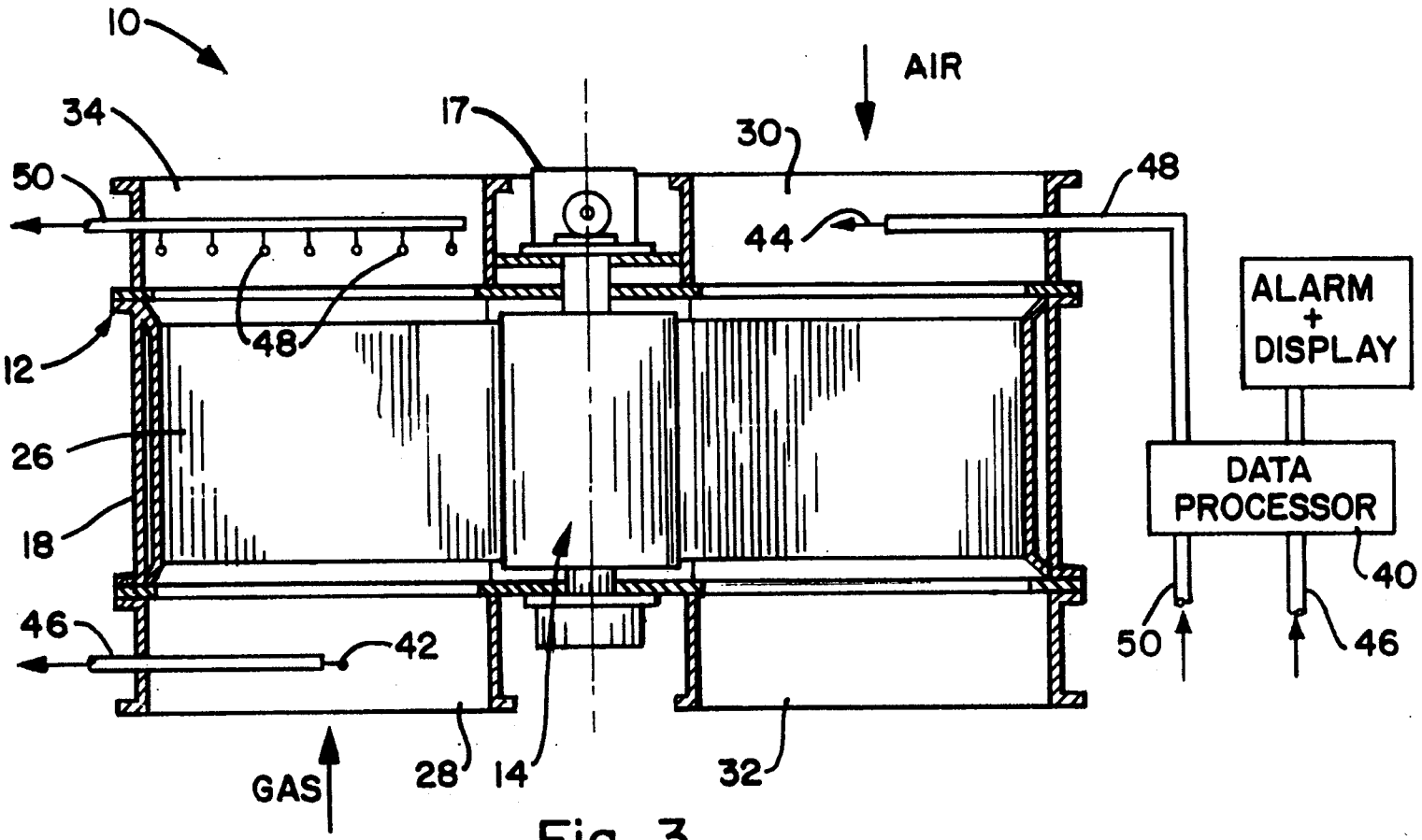
FIG. 3 is a side elevation view in cross section illustrating another embodiment of the invention.

Mounted in the air outlet duct 32 in such a manner so as to essentially span the radial extent of the rotor are a plurality of spaced apart thermocouples 36. FIGS. 2 and 3 show seven thermocouples but there may be as many thermocouples as desired. The number will depend upon the size of the air preheater but there should be a sufficient number to give a good sampling of the temperature profile across the radius of the air outlet duct. The leads from these thermocouples 36 extend through the conduit 38 to the data processor 40.

In the gas inlet duct 28 and the air inlet duct 30, the thermocouples 42 and 44 are located respectively. The leads from the thermocouples 42 and 44 extend through the conduits 46 and 48 respectively and are also fed to the data processor 40. Although only one thermocouple has been shown in each of the gas and air inlet ducts, more than one could be employed. The signals from each of the thermocouples are sent to the data processor 40. The measured temperatures are used to compute the following parameters:

$$\text{Average Effectiveness} = E_{(avg)} = \frac{T\ air\ out\ avg - T\ air\ in}{T\ gas\ in - T\ air\ in}$$

$$\text{Maximum Effectiveness} = E_{(max)} = \frac{T\ air\ out\ max - T\ air\ in}{T\ gas\ in - T\ air\ in}$$

Where:

T air in=measured air inlet temperature

T gas in=measured gas inlet temperature

T air out avg=average air outlet temperature

T air out max=maximum air outlet temperature

The average air outlet temperature, T air out avg., is an average value computed from the temperature readings of each of the thermocouples 36. The maximum air outlet temperature, T air out max., is the highest temperature reading of readings observed by the thermocouples 36. The average value of $E_{(avg)}$ over a period of time $\overline{E}_{(avg)}$ is computed and then an alarm signal is initiated if $E_{(max)}$ deviates from $\overline{E}_{(avg)}$ more than a selected percentage. In this situation, $E_{(max)}$ would increase if there is a fire and T air out max increases. In other words, if the highest temperature reading of the thermocouples 36 as it relates to the incoming air and gas temperature reaches a point where it is equal to or greater than the time-averaged value of the average of the thermocouples 36 as that relates to the incoming air and gas temperature by a selected percentage, the alarm will be triggered. By this technique, there is not a fixed set point but a variable point controlled by the relationship of the maximum to the average outlet air temperature and variations of the incoming air and gas temperatures. The alarm is determined by and thus able to accommodate changes in the air and gas inlet temperatures. This reduces the chance of a spurious alarm signal that would otherwise merely be the result of a high air or gas inlet temperature. Also, a fire that occurs during start-up, shut-down, or other transient conditions will be more easily detected since a fixed increase in $E_{(max)}$ will trigger the alarm rather than an increase to a predetermined temperature set point which may be the high for such transient conditions.

Using the measured effectiveness of the air preheater as the basis for the alarm set point is superior to a simpler method that only monitors the outlet temperature of the air (or gas) and sends an alarm when one of the measured outlet temperatures goes above a certain fixed value. The former method would be just as sensitive when the steady-state gas inlet temperature is, say, 500° F., as when the gas inlet temperature is, say 700° F. The latter method would require a much larger increase in the outlet temperature with the entering gas at 500° F. than it would with the gas entering at 700° F., because the alarm set point would have to be high enough so that it doesn't trigger an alarm when the entering gas is at 700° F. This is not the case for the effectiveness method because the steady-state effectiveness of the air preheater is relatively insensitive to changes in the inlet temperatures and flow rates (within normal ranges, that is). Thus, whether the steady-state entering gas temperature is 500° F. or 700° F., the alarm set point based on effectiveness is nearly the same.

When the maximum effectiveness exceeds the alarm set point, an alarm signal is sent. Thus, to avoid spurious alarms, the alarm set point must be based on an accurately measured effectiveness for the air preheater, and it must not be biased by any of the normal air temperature fluctuations that can occur in an air preheater. The measured effectiveness of the preheater could be computed simply by taking one instantaneous set of temperature readings from the multiple thermocouples in the air (or gas) outlet stream, together with the measured air and gas inlet temperatures. However, in view of the possibility of compartment-to-compartment variations in the air (or gas) outlet temperatures and the stochastic fluctuations in those measured temperatures, a single set of readings may not provide a sufficiently accurate value for the effectiveness of the air preheater. A more accurate value of the air outlet temperature is obtained by using a moving time-averaged air outlet temperature that is based on the readings from several (three as a recommended minimum, more if feasible) different compartments in the air preheater. Using a time-averaged effectiveness will help to eliminate some of the normal fluctuations in measured outlet temperatures, and thereby produce a steadier and more accurate alarm set point, since the alarm set point is defined as a multiple of the time-averaged effectiveness.

In practice, one would know the number of radial compartments in the air preheater, as well as the rotational speed of the rotor. Thus, by defining a fixed time interval for storing the air outlet temperatures, one can determine which compartments' temperatures are used in calculating the time-averaged effectiveness. For example, if the rotor has 20 compartments, and the rotational speed is 0.025 rev/sec, then specifying a sampling interval of 12 seconds would mean that the air outlet temperature from every sixth compartment (i.e., those compartments numbered 1, 7, 13, 19, 5, 11, . . . ) would be used to calculate the time-averaged effectiveness. Any time interval that repeatedly samples the same compartments (eg., 1, 11, 1, 11, . . . ) is not recommended.

During a transient, the air (and gas) outlet temperatures will be changing in response to the changes in the air or gas inlet temperatures or flow rates. Since the thermal capacity of the rotor matrix is usually quite large, there will be a certain lag time in the response of the outlet temperatures, so they will change more slowly than the inlet temperatures. The response time for a given air preheater can be calculated or measured. The sampling time interval should then be chosen so it is short in comparison to the response time of the air preheater. This will ensure that the time-averaged effectiveness is not lagging too far behind the actual effectiveness during a transient.

The response time of the air preheater will determine how fast the air and gas outlet temperatures change after an instantaneous change in either the gas or air inlet temperatures. If we assume that the multitude of thermocouples are located in the air outlet duct, that the gas inlet temperature instantaneously decreases at time t=0, and that the response time of the air preheater is on the order of 15–20 minutes, then it is physically impossible for the time-averaged air outlet temperature to change much during the first few minutes after t=0. During the initial few minutes of this transient, the quick change in the gas inlet temperature will cause the calculated maximum effectiveness to increase rapidly to some maximum value that depends on the new value of the gas inlet temperature. As the air outlet slowly drops, the maximum effectiveness will decline slowly to its steady-state value. To avoid triggering the alarm when the maximum effectiveness increases, the percentage deviation from $\bar{E}_{(avg)}$ is used to define the alarm set point in relation to the time-averaged effectiveness. An appropriate value percentage can be determined from measured or calculated temperatures for a worst-case transient.

FIG. 3 shows an alternate form of the present invention in which the thermocouple array is located in the gas outlet duct instead of the air outlet duct. In this situation, the plurality of thermocouples 48 are in the gas outlet duct 34 while the other thermocouples 42 and 44 remain in the gas inlet duct 28 and the air inlet duct 30. The thermocouples 48 are connected into the data processor 40 through conduit 50. In this case:

$$E_{(avg)} = \frac{T\ gas\ in - T\ gas\ out\ avg}{T\ gas\ in - T\ air\ in}$$

$$E_{(max)} = \frac{T\ gas\ in - T\ gas\ out\ max}{T\ gas\ in - T\ air\ in}$$

Again, the time-average value of $E_{(avg)}$ is computed and the alarm sounds if $E_{(max)}$ deviates more than a selected percentage from $\bar{E}_{(avg)}$. In this situation, $E_{(max)}$ will decrease if there is a fire and T gas out max increases.

We claim:

1. A heat exchanger comprising:

a stationary housing having hot and cold ends and first and second sides;

a matrix of heat exchange material supported to revolve within said housing about an axis of revolution passing through said hot and cold ends whereby said matrix revolves through said first and second sides;

gas duct inlet means and gas duct outlet means fluidly connected to said housing on one of said first and second sides for introducing a flow of hot gas into said matrix at said housing hot end to raise the temperature of said matrix and discharging said gas from said matrix at said housing cold end respectively;

air duct inlet means and air duct outlet means fluidly connected to said housing on the other of said sides for introducing a flow of cold air into said matrix at said housing cold end to raise the temperature of said air and discharging said air from said matrix at said housing hot end respectively;

a plurality of temperature measurement means in said outlet duct means of said first side located at spaced intervals spanning the radial dimension of said matrix for measuring the temperatures at said spaced intervals;

at least one temperature measurement means located in said inlet duct means of said first side for measuring the incoming temperature on said first side;

at least one temperature measurement means located in said inlet duct means on said second side for measuring the incoming temperature on said second side;

means for computing the average effectiveness $E_{(avg)}$ of said heat exchanger wherein $E_{(avg)}$ equals the ratio of the temperature difference between the average of said plurality of temperature measurements and said incoming temperature on said first side to the temperature difference between said incoming temperature on said first side and said incoming temperature on said second side;

means for computing the maximum effectiveness $E_{(max)}$ of said heat exchanger wherein $E_{(max)}$ equals the ratio of the temperature difference between the highest temperature of said plurality of temperature measurements and said incoming temperatures on said first side to the temperature difference between said incoming temperature on said first side and said incoming temperature on said second side;

means for computing a time-averaged value $\bar{E}_{(avg)}$ of $E_{(avg)}$ and means for initiating an alarm when $E_{(max)}$ deviates from $\bar{E}_{(avg)}$ more than a selected percentage of $\bar{E}_{(avg)}$.

2. A heat exchanger as recited in claim 1 wherein said first side includes said air duct inlet and outlet means and said plurality of temperature measurement means are located in said air duct outlet means.

3. A heat exchanger as recited in claim 1 wherein said first side includes said gas duct inlet and outlet means and said plurality of temperature measurement means are located in said gas duct outlet means.

4. A heat exchanger as recited in claim 1 wherein said temperature measurement means comprise thermocouples.

5. A method of detecting an abnormally high temperature within the heat transfer rotor of a rotary regenerative heat exchanger having a stationary housing having hot and cold ends and first and second sides, a heat transfer rotor supported to revolve within said housing about an axis of revolution passing through said hot and cold ends whereby said rotor revolves through said first and second sides from said hot end to said cold end, inlet and outlet duct means for passing a heating fluid through said rotor on one of said first and second sides, and inlet and outlet duct means for passing fluid to be heated through said rotor on the other of said sides from said cold end to said hot end, said method comprising the steps of:

measuring the temperature in said outlet duct means of said first side at a plurality of locations spaced at intervals spanning the radial dimension of said rotor;

measuring the temperature at least at one location in each of said inlet ducts;

computing the average effectiveness $E_{(avg)}$ of said heat exchanger wherein $E_{(avg)}$ equals the ratio of the temperature difference between the average of said plurality of temperature measurements and said incoming temperature on said first side to the temperature difference between said incoming temperature on said first side and said incoming temperature on said second side;

computing the maximum effectiveness $E_{(max)}$ of said heat exchanger wherein $E_{(max)}$ equals the ratio of the temperature difference between the highest temperature of said plurality of temperature measurements and said incoming temperatures on said first side to the temperature difference between said incoming temperature on said first side and said incoming temperature on said second side;

computing a time-averaged value $\overline{E}_{(avg)}$ of $E_{(avg)}$;

initiating an alarm when $E_{(max)}$ deviates from $\overline{E}_{(avg)}$ more than a selected percentage of $\overline{E}_{(avg)}$.

* * * * *